US005094461A

United States Patent [19]

Lowrance

[11] Patent Number: 5,094,461

[45] Date of Patent: Mar. 10, 1992

[54] FISHING GAME APPARATUS

[76] Inventor: Arlen J. Lowrance, 2121 S. Yorktown #802, Tulsa, Okla. 74114

[21] Appl. No.: 667,178

[22] Filed: Mar. 11, 1991

Related U.S. Application Data

[63] Continuation-in-part of Ser. No. 652,788, Feb. 8, 1991.

[51] Int. Cl.[5] ..... A63F 9/00

[52] U.S. Cl. ..... 273/343; 273/140; 273/393

[58] Field of Search ..... 273/393, 343, 345, 346, 273/348, 350, 378, 383, 140, 347

[56] References Cited

U.S. PATENT DOCUMENTS

| | | | |
|---|---|---|---|
| 2,320,145 | 5/1943 | La Due | 273/350 |
| 2,343,002 | 2/1944 | Colaluca | 273/393 |
| 2,393,726 | 1/1946 | Yejoff | 273/140 |
| 2,482,057 | 9/1949 | Fincke | 273/393 |
| 2,511,430 | 6/1950 | Colaluca | 273/393 |
| 2,598,487 | 5/1952 | Anechiarico | 273/140 X |
| 2,611,617 | 9/1952 | Strohm | 273/140 |
| 2,703,469 | 3/1955 | Raizen | 273/140 |
| 3,463,494 | 8/1969 | Stroh | 273/345 |
| 3,620,532 | 11/1971 | Graf | 273/140 X |
| 4,976,439 | 12/1990 | Kraemer | 273/350 |

*Primary Examiner*—William H. Grieb
*Attorney, Agent, or Firm*—William S. Dorman

[57] ABSTRACT

A fishing device or apparatus wherein a plurality of flat vertical objects resembling fish are arranged in a horizontal row along a horizontal support. Each fish is provided with a mouth and a slot which connects with a circular opening below the mouth. For the purpose of catching the fish, the would-be fisherman, or player, will utilize a casting rod with a winding reel. The end of the line which connects with the fishing rod and the reel, however, will be provided with a plug which cooperates with the circular opening below the mouth of the fish. The plug is made of resilient material, such as rubber or plastic, and is provided with a nose piece adjacent the connection of the line to the plug. This nose piece is tapered from a diameter of smaller size than the circular opening in the fish to a diameter slightly larger than the diameter in the opening. Immediately beyond the larger diameter of the nose piece, the plug is provided with a recess so that when the plug is pulled into the opening, the nose piece will squeeze through the opening until the sides of the opening are lodged in the recess. Further pulling on the line will pull the fish off the horizontal support and the fish is now "caught".

9 Claims, 10 Drawing Sheets

FISHING GAME APPARATUS

CROSS REFERENCE TO OTHER APPLICATIONS

This Application is a continuation-in-part of co-pending Application Ser. No. 07/652,788, filed on Feb. 8, 1991, entitled "Fishing Game Apparatus".

BACKGROUND OF THE INVENTION

1. Field of the Invention

The present invention relates to an apparatus or device which can be used to simulate fishing. More particularly, the apparatus of the present invention includes a plurality of artificial fish which are temporarily retained on a support and which are removed from the support using an operation which is similar to the action of fishing by casting a plug.

2. The Prior Art

There are numerous games or devices wherein "fish" are involved as game pieces or tokens. However, the prior art does not disclose a fishing device or apparatus of the type disclosed herein.

SUMMARY OF THE INVENTION

The present invention involves a fishing device or apparatus wherein a plurality of flat vertical objects resembling fish are arranged in a horizontal row along a horizontal support. Each "fish" is provided with a wire latch shaped in the form of a wide angled "V". Each latch is adapted to be received in a vertical notch on the horizontal support for the fish. Each fish is provided with a mouth which is in alignment with the notch. The lower portion of each mouth is provided with a slot which connects with a circular opening below the mouth.

For the purpose of catching the fish, the would-be fisherman, or player, will utilize a casting rod with a winding reel, which form no part of this invention. The end of the line which connects with the fishing rod and the reel, however, will be provided with a plug which cooperates with the circular opening below the mouth of the fish. The plug is made of resilient material, such as rubber or plastic, and is provided with a nose piece adjacent the connection of the line to the plug. This nose piece is tapered from a diameter of smaller size than the circular opening in the fish to a diameter slightly larger than the diameter in the opening. Immediately beyond the larger diameter of the nose piece, the plug is provided with a recess so that when the plug is pulled into the opening, the nose piece will squeeze through the opening until the sides of the opening are lodged in the recess. Further pulling on the line will pull the fish off the horizontal support and the fish is now "caught".

In order to assist the fisherman in directing his line into the slot and circular opening of each fish, a horizontal bar or pipe is located on the fishing device above and to the rear of the horizontal support upon which the "fish" are mounted. The fisherman will cast his plug over this upper and rear horizontal pipe and then, by sidewise tugging on the line, move the line until it is positioned approximately over the notch in which the desired fish is received. The fisherman will then reel in the line until the plug is pulled over the rear horizontal bar so that the plug and line will fall into or near the indicated notch. Further sidewise manipulation may be required to move the line into the slot and, hence, into the circular opening of the fish.

Another feature of the present invention involves a timing device which is actuated, or started, in response to the removal of one of the fish and which is stopped after the removal of the last fish so as to determine the total elapsed time for the removal of all of the fish from the horizontal support. Another modification of the present invention involves the use of loops on the horizontal support above the notches for simulating the action of the fisherman who likes to fish with a bow and arrow. It will be necessary for the archer/fisherman to shoot the arrow through the loop above the fish to be removed. The head of the arrow is provided with a nose piece which is shaped in the same manner as the plug described above.

In another embodiment of the present invention, the wire latch is eliminated and a different type of releasable holding means is employed for supporting the fish on the horizontal support. The notches on the horizontal support are also eliminated. Instead, the horizontal support is provided with a plurality of horizontal screws arranged in spaced relation along the horizontal support, one screw for each fish. Each fish is provided with a second circular opening located below the first circular opening and being provided with a vertical slot at the upper end thereof so that the second circular opening and slot resemble an inverted keyhole. The fish are attached to the horizontal support by placing the second circular hole over the bolt and allowing the fish to drop down such that the shank of the bolt is received in the slot above the second circular opening. The head of the bolt will prevent the fish from falling off the support. The plug will be pulled into the upper circular opening in much the same manner as previously described, and further tugging on the line thereafter will cause the fish to lift so that the slot is clear of the shank of the bolt and the fish is removed from the horizontal support. This modified form of releasable holding means also includes a plurality of loops on the horizontal support to simulate the action of fishing with a bow and arrow.

DETAILED DESCRIPTION OF THE PREFERRED EMBODIMENTS

Figure 1:
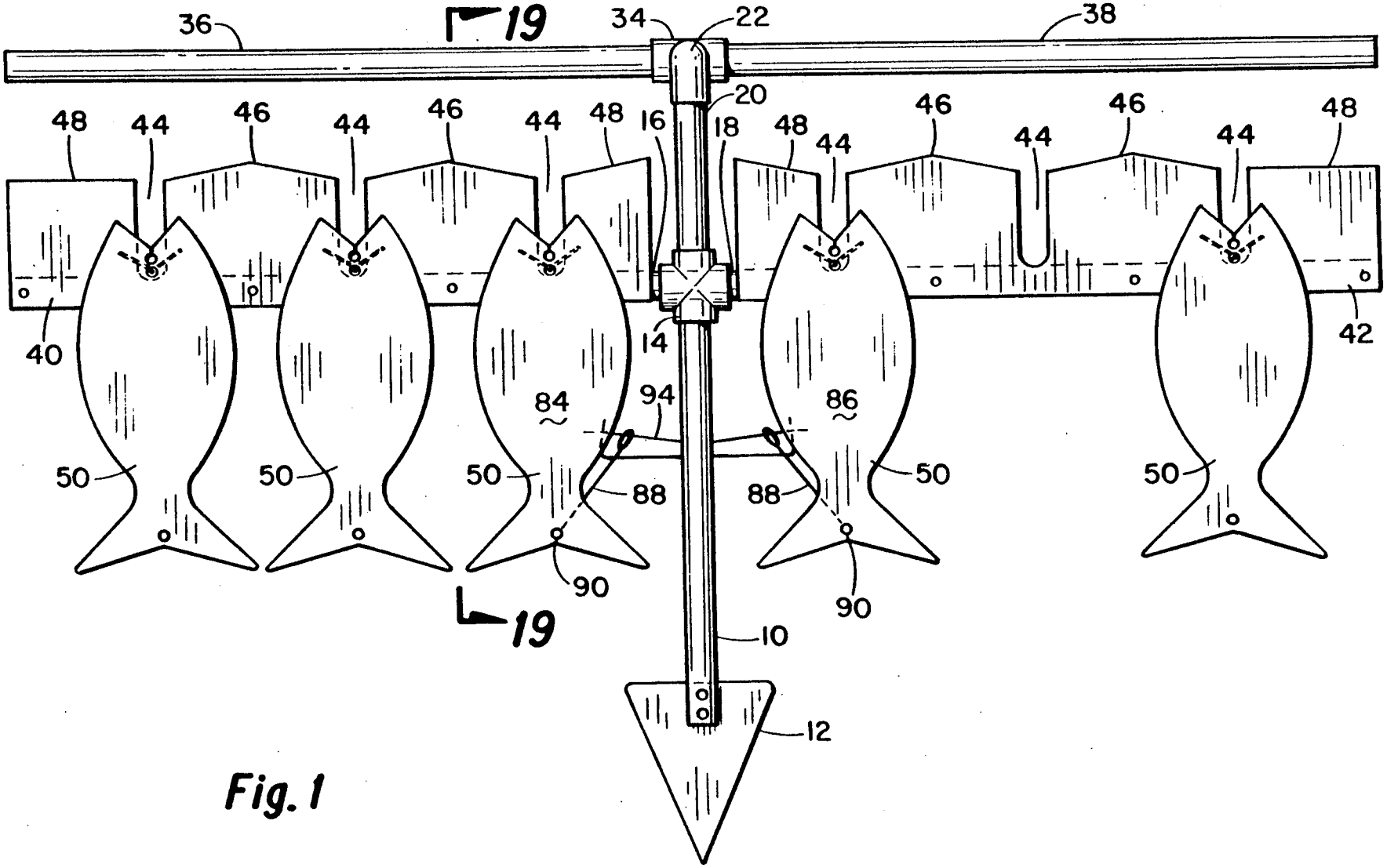
FIG. 1 is a front elevation of a fishing device constructed in accordance with one embodiment of the present invention.

Referring to the drawings in detail, FIG. 1 shows a vertical pipe 10 which can be impaled in the ground with a suitable spade 12. The top of the pipe 10 connects with a four-way coupling 14 which, in turn, connects with a pair of horizontal pipes 16 and 18 and a vertical pipe 20. The top of the pipe 20 (see FIG. 19) connects with an elbow 22. The elbow connects with a short horizontal piece of pipe 24 which connects with an inverted tee 26. The down opening 28 of the tee 26 connects with a vertical piece of pipe 30 for a purpose which will hereinafter appear. The rear opening of the tee 26 connects with a horizontal nipple 32 which in turn connects with a tee 34. The sides of the tee connect with two horizontal pipes 36 and 38, respectively. At this juncture it should appear that the pipes 36 and 38 are disposed parallel to, above and to the rear of, pipes 16 and 18 for a purpose which will hereinafter appear.

A relatively thin vertical plate 40 of metal or plastic material is attached to the pipe 16, and a similar plate 42 is attached to the pipe 18. Each plate is provided with a plurality of vertical notches or slots 44 for securing fish therein. The solid portions 46 of each plate between the notches 44 are provided with inclined edges which form an apex of the top of each section 46 so that a fishing line can slide into a notch 44 as will hereinafter appear. Each plate 40 or 42 is provided with end portions 48, each of which has an upper edge that tapers upwardly away from the adjacent notch 44.

Figure 2:
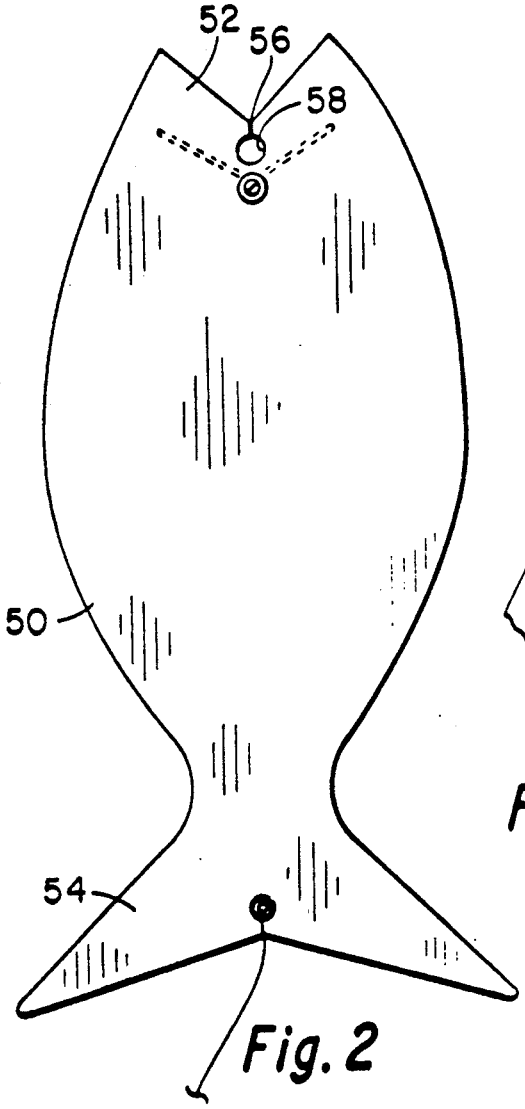
FIG. 2 is a front elevation, on a slightly enlarged scale, of one of the individual fish shown in FIG. 1.
Figure 4:
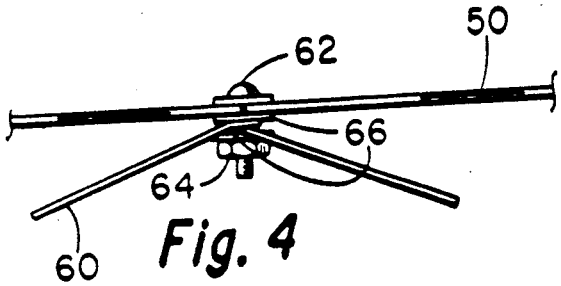
FIG. 4 is a fragmentary plan view taken along line 4—4 of FIG. 3.
Figure 3:
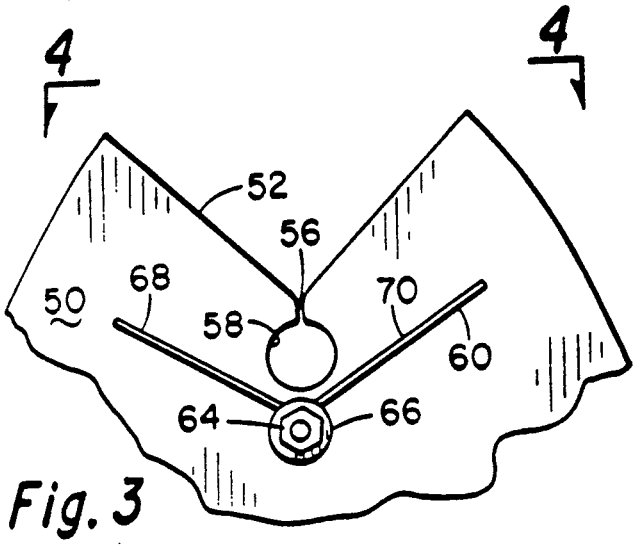
FIG. 3 is a partial rear elevation, on a further enlarged scale, of the fish shown in FIG. 2.

Turning now to FIGS. 2, 3 and 4, these Figures show a fish shaped member or "fish" 50 in the form of a thin plate of metal or plastic and having an outline resembling that of a fish. Each fish 50 has an angled mouth portion 52 at the upper end and a lower tail portion 54. As best shown in FIG. 3, the inner apex of the mouth 52 is provided with a narrow slot 56 which leads into a circular opening 58. A wire member 60 is connected to the rear of the fish 50 by means of a bolt 62 which passes through a suitable opening in the fish 50 below the opening 58. A threaded nut 64 is received on the bolt 62 to hold the wire 60 in position. The wire is received on the bolt 62 between a pair of washers 66. The wire 60 is wrapped, for at least one turn, around the bolt 62 with the result that the outer projecting portions or arms 68 and 70 form a wide angled "V". The resulting "V" is secured in the position shown by holding the wire while tightening the nut 64.

The space between the back of the fish 50 and the inner ends of the arms 68 and 70 is equal to, or slightly greater than, the thickness of the plate 40 or 42 such that a fish 50 can be dropped into any slot 44 as shown in FIG. 1. The bolt 62, with the wrapping of wire thereon, will rest against the bottom of the notch 44 while the arms 68 and 70 will prevent the fish 50 from falling out forwardly.

Figure 5:
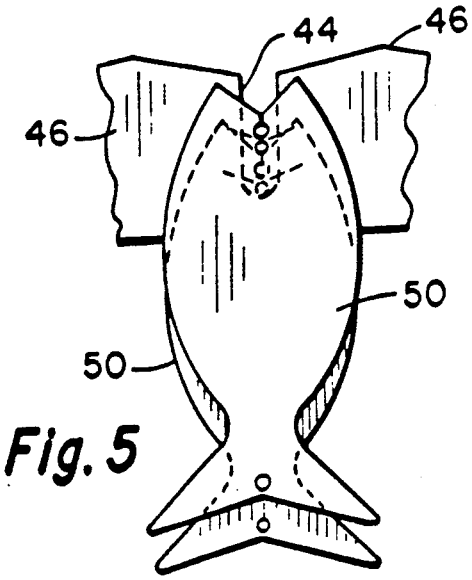
FIG. 5 is a partial front elevation of the invention shown in FIG. 1 illustrating a stacking arrangement.

Each notch 44 is sufficiently high in vertical extent that more than one fish 50 can be received in a given slot 44. FIG. 5 shows two fish 50 received in a slot 44. The lower fish 50 will be received in the slot 44 in the same manner as shown in FIG. 1. The outer, or upper, fish 50 will be received in the slot 44 such that the bolt 62, with the wire wrapped thereon, will rest against the apex of the mouth 52 of the underlying fish 50. The body of the upper fish 50 will also be angled out slightly.

Figure 8:
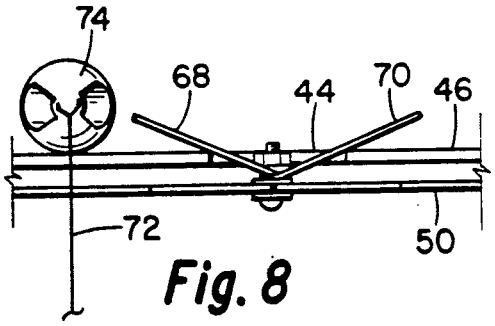
FIG. 8 is a plan view of the elements shown in FIG. 7.
Figure 10:
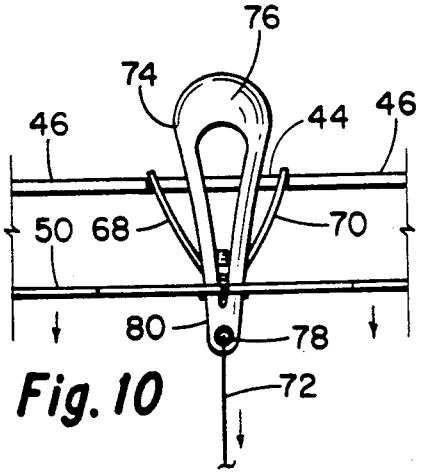
FIG. 10 is a plan view of the elements shown in FIG. 9.
Figure 7:
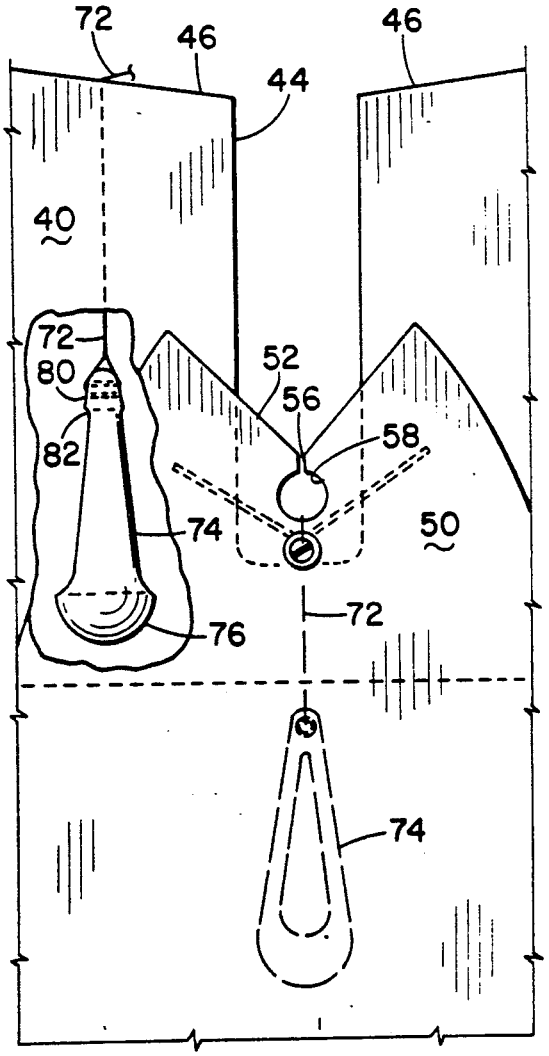
FIG. 7 is a partial front elevation, with a part broken away, to show the snaring device used on the end of the fish line.
Figure 9:
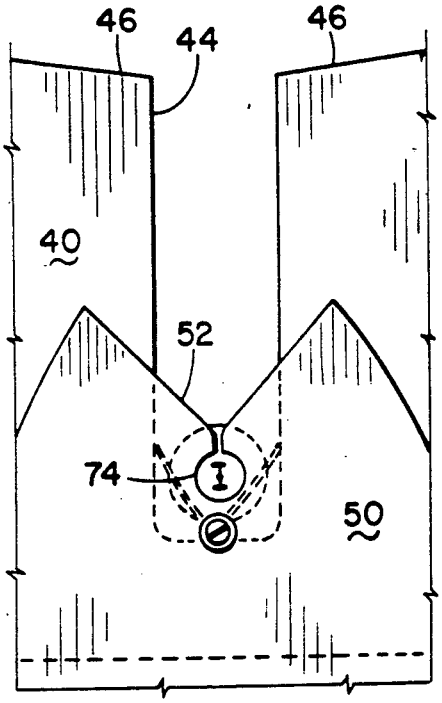
FIG. 9 is a view, similar to FIG. 7, showing the snaring device lodged in the mouth of the fish.

The manner in which the fish 50 of the present invention are snared, or caught, will now be described in relation to FIGS. 7 through 17. The person playing this game, or sport, will use any conventional fishing rod and reel (not shown) using a conventional fishing line 72 of suitable strength and durability for the purposes of the game. The outer end of the line 72 will be provided with a "plug" 74 of special design for the purposes of the present invention. As best shown in FIGS. 7, 8 and 10, the plug 74 will be essentially conical in shape with an enlarged bulb 76 at the outer end thereon to provide suitable weight. The plug 74 is preferably made out of resilient material, such as rubber or plastic. The end of the plug 74 opposite the bulb 76 is provided with an opening 78. The end of the line 72 is secured to the plug 74 through the opening 78 in any conventional manner. The upper end of the plug 74 is provided with a portion 80 which tapers outwardly and downwardly (in relation to FIG. 7). An indent or recess 82 is provided in the plug below the tapered portion 80. The top of the tapered portion 80 is smaller than the diameter of the opening 58 in the fish 50. However, the bottom of the tapered portion 80, immediately above the recess 82, is slightly larger than the opening 58.

When the line 72, immediately adjacent the plug 74, is received in the slot 56 so that it can pass into the opening 58, pulling on the line 72 will cause the tapered portion 80 to be received in the opening 58. Continued pulling (or jerking) on the line 72 will cause the entire tapered portion 80 to pass through the opening 58 until the sides of the opening are received in the recess 82. Even though the bottom of the tapered portion 80 is slightly larger than the opening 58, as described above, the resilient nature of the plug 74 is such that it will squeeze through the opening 58 until it is locked in place when the recess 82 is received against the sides of the opening 58. A slight tug on the plug 74, away from the fish 50, will result in removal of the plug 74 from the fish 50 at a later time.

Figure 11:
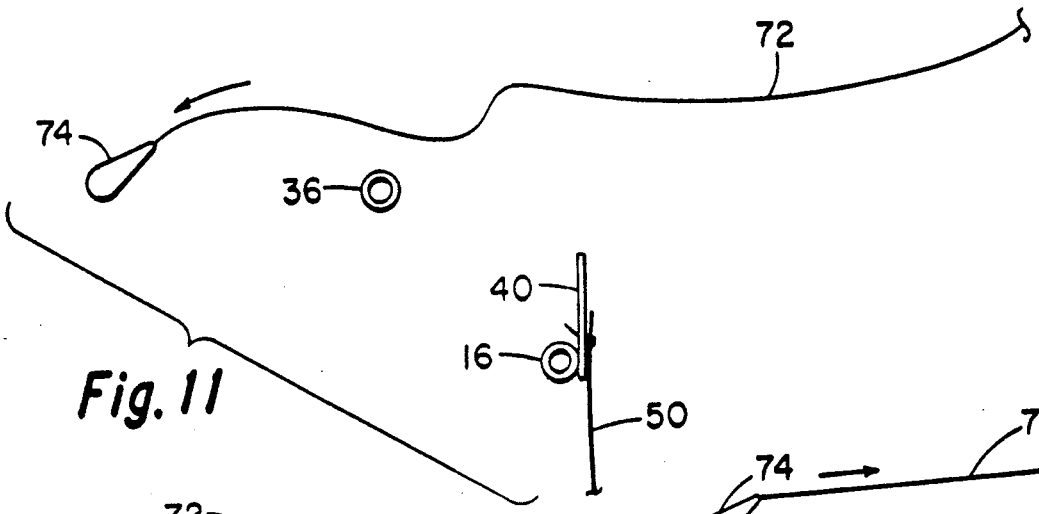
FIG. 11 is a diagrammatical side elevational view representing a successful cast above the top rod of the device shown in FIG. 1.
Figure 12:
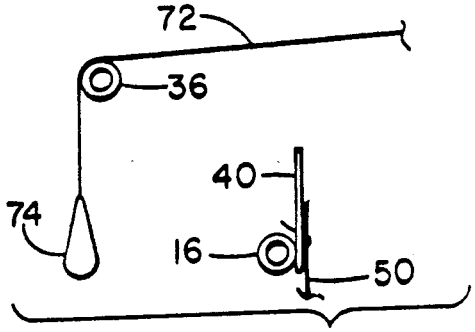
FIG. 12 is a diagrammatical view showing the next step in the sequence initiated by FIG. 11.
Figure 13:
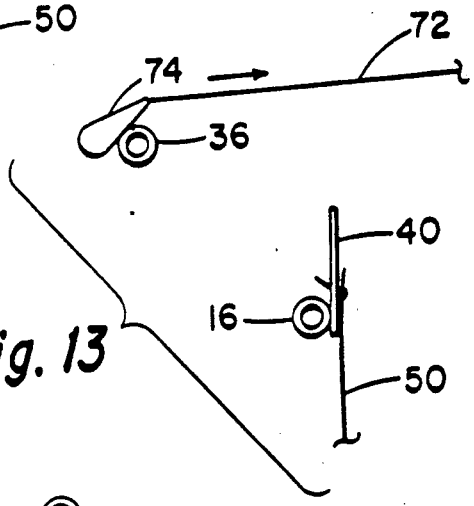
FIG. 13 is a diagrammatical view showing the next step in the sequence following the step of FIG. 12.
Figure 14:
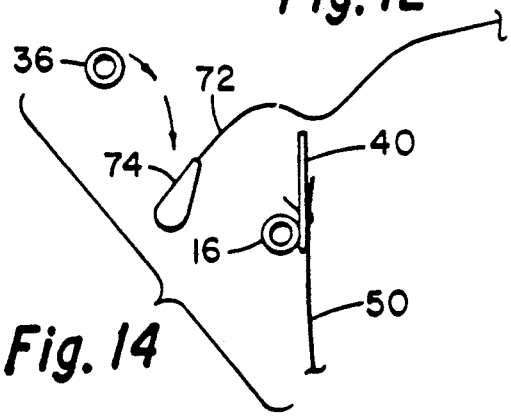
FIG. 14 is a diagrammatical view showing the next step in the sequence following the step of FIG. 13.

As shown in FIG. 11, the operator (not shown) of the game or sport, which is the subject of this invention, will cast his line 72 so that the plug 74 is lobbed over one of the upper horizontal pipes 36 or 38. For the purposes of the description of FIGS. 11 through 17, it will be assumed that the operator has lobbed his plug over the pipe 36. The pipe 36 is above and behind the lower pipe 16 which supports the plate 40. When the plug 74 comes to rest over the pipe 36, as shown in FIG. 12, the operator will first move the plug along the pipe 36 by sidewise tugging on the line 72 until the line is over one of the notches 44. Thereafter, he will commence reeling in the line 72 until the plug 74 creeps over the horizontal pipe 36 as shown in FIG. 13. Continued pulling on the line 72 will cause the plug 74 to fall forwardly as shown in FIG. 14. Immediately thereafter, the line 72 will pass into the slot 44 or will come to rest on the top of one of the members 46 as shown in FIG. 7.

Figure 15:
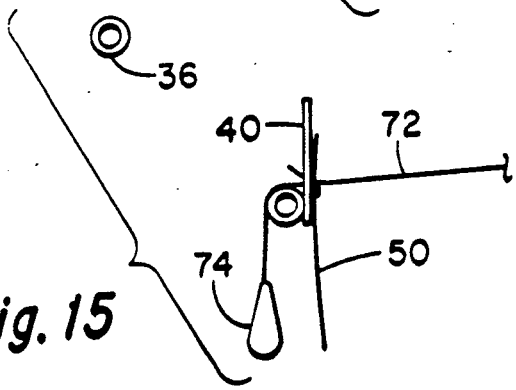
FIG. 15 is a diagrammatical view showing the next step in the sequence following the step of FIG. 14.
Figure 16:
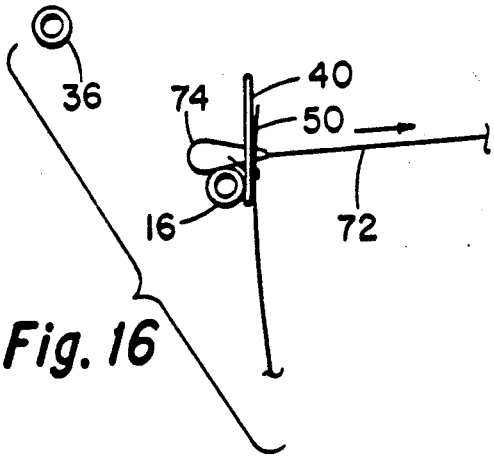
FIG. 16 is a diagrammatical view showing the next step in the sequence following the step of FIG. 15.
Figure 17:
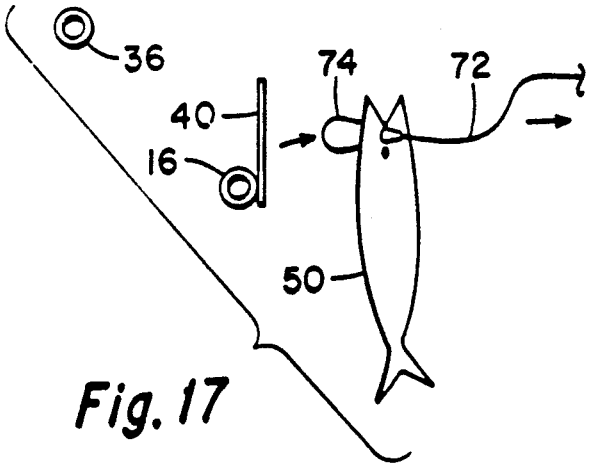
FIG. 17 is a diagrammatical view showing the final step in the sequence from FIGS. 11 through 16 where the snared fish is removed from its support.

In the event that the line is resting on one of the members 46, as shown in FIG. 7, a sidewise tug to the right will cause the line 72 to slide down the incline of the member 46 until the line 72 drops down into the recess 82, into the mouth 52, through the slot 56 and into the opening 58 so that the plug 74 is hanging down in line with the center of the opening 58, as shown in the dotted line position in FIG. 7 and as represented by relative positions of the elements shown in FIG. 15. From the dotted line position of the line 72 in FIG. 7, continued pulling on the line 72 will cause the tapered portion 80 of the plug 74 to be received in the opening 58 as previously described and as shown in FIG. 16. Further pulling on the line 72 will either lift the fish 50 upperwardly out of the notch 44, or as shown in FIG. 10, will cause the arms 68 and 70 to bend towards each other as they are pulled through the slot 44 to release the fish 50 from the plate 40 as shown in FIG. 17. The plug 74 can now be removed from the fish 50, in the manner previously described, and the operator is now ready to go after another fish.

Figure 19:
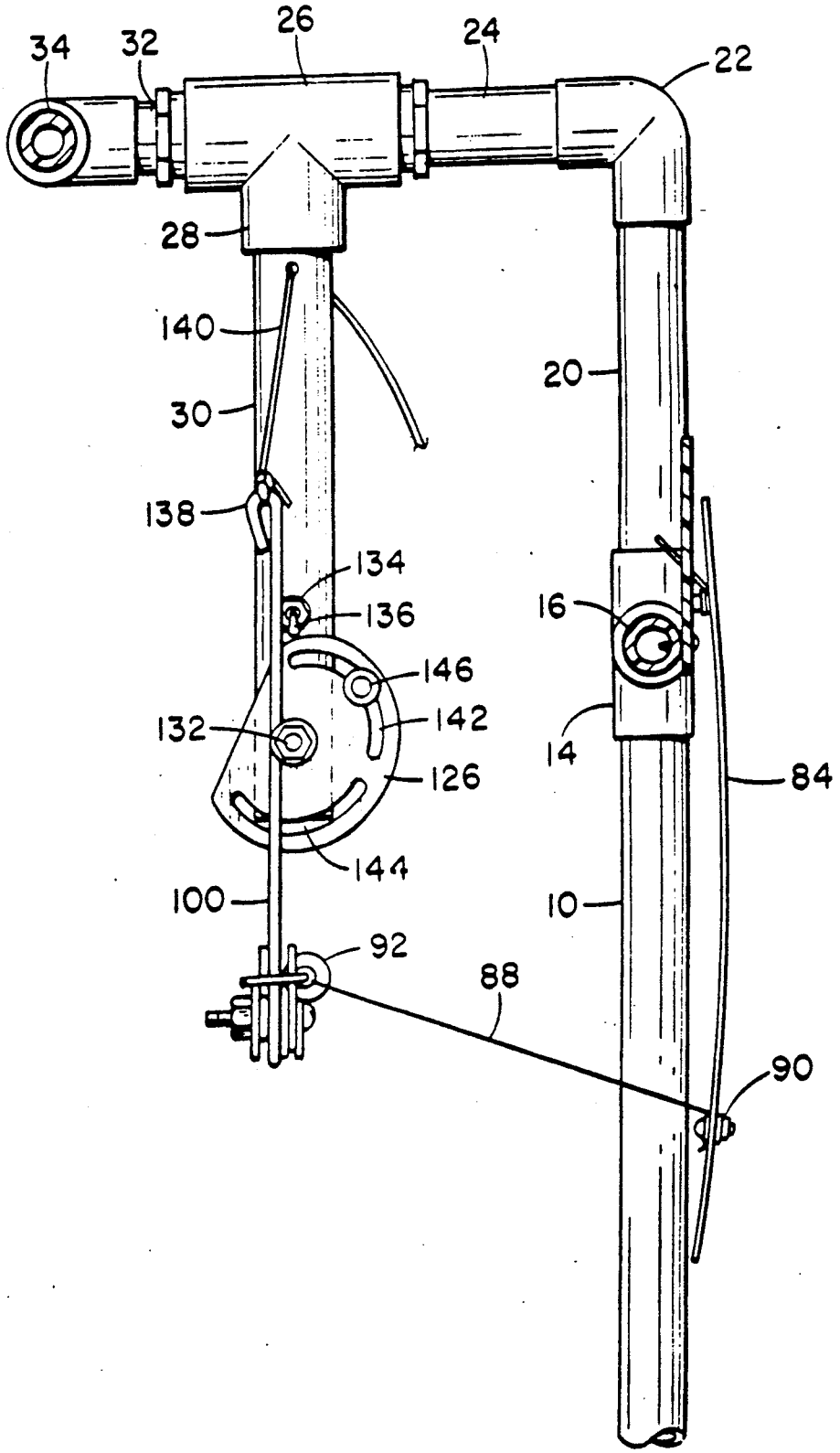
FIG. 19 is a sectional view taken along section line 19—19 of FIG. 1.
Figure 21:
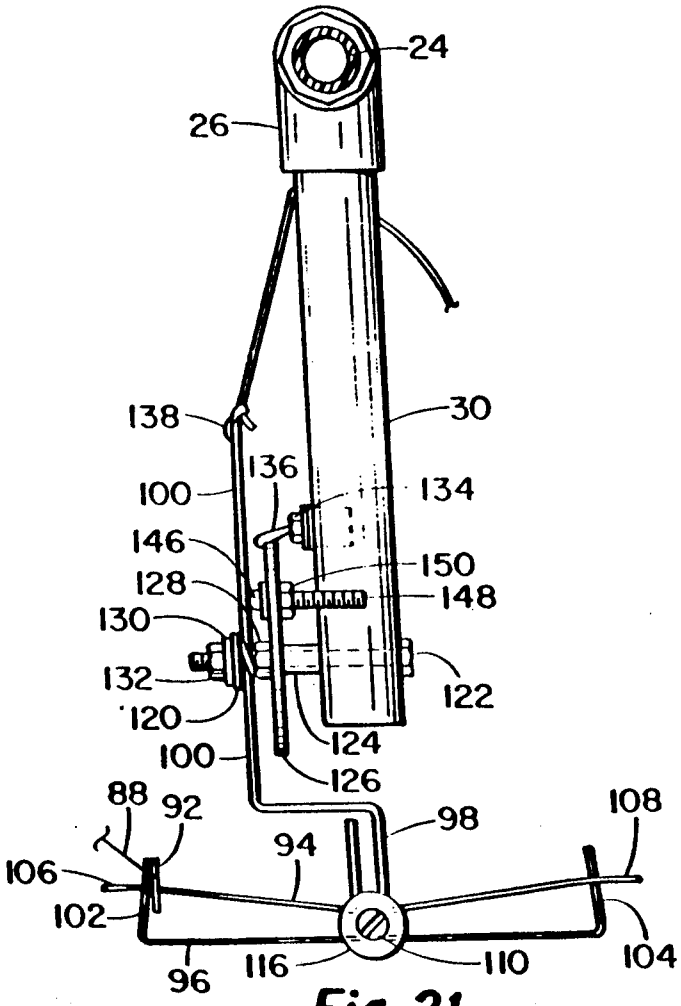
FIG. 21 is a sectional view taken along section line 21—21 of FIG. 20.
Figure 20:
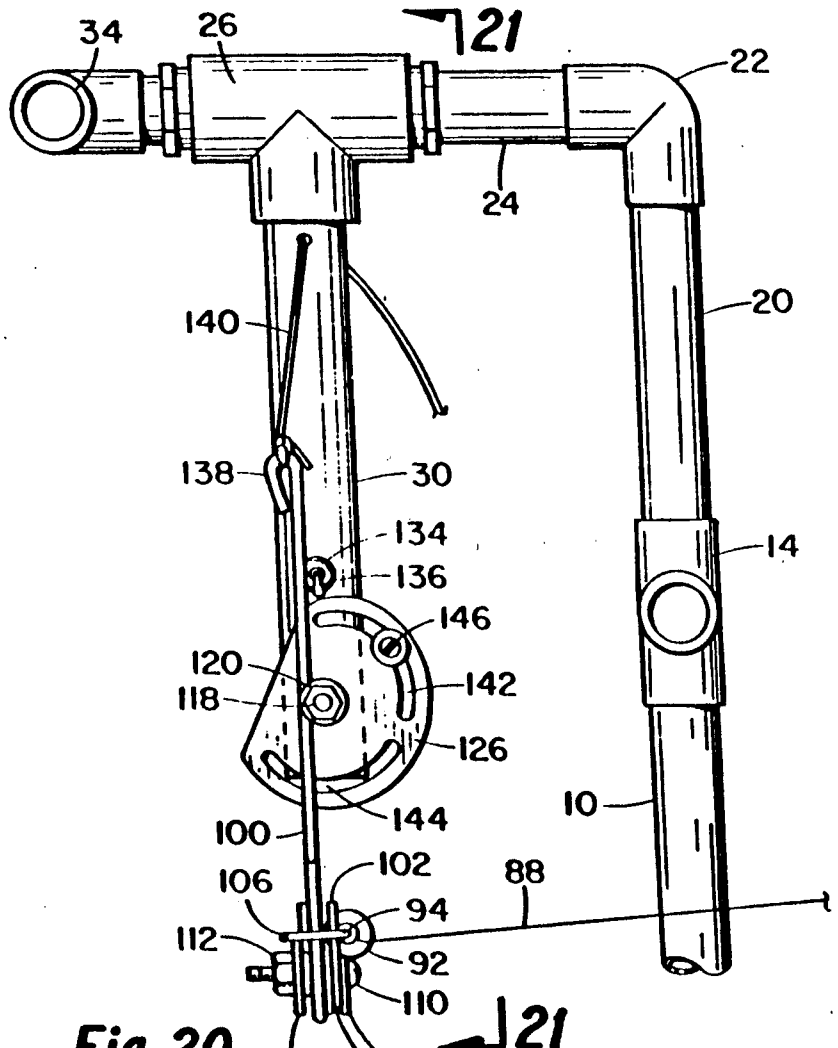
FIG. 20 is a view, similar to FIG. 19, representing the next step in sequence in removing the fish.

The present invention provides a system for "timing" the playing of the game or sport to make the same a timed contest. This timing system is shown in FIGS. 19 to 21. For the purpose of actuating a timer (not shown) the two inside fish 50, also designated by the reference numerals 84 and 86, will be the "starting" and "stopping" fish. Thus, when using the timing feature of the present invention one would snare or "catch" fish 84 or 86 to start the timer, as will be described hereinafter; he will then catch all of the intermediate fish and end up with the other remaining inside fish (84 or 86) to stop the timer, thus providing a timed indication of how long it took him to catch all of the fish. For the purpose of the following description, it will be assumed that the operator starts the sequence of events with the catching of fish 84, although obviously the sequence can be started by catching fish 86.

As shown in FIG. 19, fish 84 differs from the other fish 50 (except fish 86) in that it is provided with a line 88 which is secured at one end to the bottom of the fish 84 by means of a nut and bolt 90 or any other convenient means for securing a line to an object. The other end of the line 88 connects with a circular washer 92 which is received on a wire 94 (see also FIG. 1 and 21).

The wire 94 cooperates with another wire 96 and both wires are mounted on a loop 98 located at the bottom end of a lever 100. The wire 96 is in the form of a short "U" with a wide throat formed by the elongated bottom of the wire 96 and two short vertical wire extensions 102 and 104. The wire 94 extends across the front of the wire 96 and is bent at its ends 106 and 108 to extend slightly rearwardly of the vertical extensions 102 and 104, respectively. The two wires 94 and 96 are secured to the loop 98 by means of a bolt 110, nut 112 and washers 114 and 116. When positioning the fish 84 and 86 on the plates 40 and 42, respectively, the arms 106 and 108 are pulled outwardly slightly and the washers 94 are slipped onto the wire 94. When the pressure on the ends 106 and 108 is released, the washers 92 will be retained on the wire 94 between the center and the vertical arm 102 or 104. When the fish 84, for example, is caught in the manner described above, pulling on the line 72 will not only release the fish from the plate 40, in the manner described above, but continued pulling on the line 72 will cause a pull on the line 88, as shown in FIGS. 19 and 20. The initial pull on the line 88 will cause the lever 100 to pivot around its center point 118 in a manner to be described below and continued pulling on the line 88 will cause the arm 94 to bend forwardly whereby the washer 92 will slip past the end 106 of the arm 94 to release the fish 84 from engagement with the timing mechanism. Thereafter, the lever 100 will return to the solid line position shown in FIGS. 19 and 20.

The lever 100 is provided with a loop 120 at its center point 118. A bolt 122 extends through the vertical pipe 30 and through the loop 120. A sleeve 124 is also received on the bolt 122 on the opposite side of the pipe 30 from the head of the bolt 122. A cam 126, later to be described, is also mounted on the bolt 122 and a nut 128 urges the cam 126 against the sleeve 124 such that the cam 126 will rotate when the bolt 122 and lever 100 rotates. As shown in FIG. 21, the loop 120 of the lever 100 is received on the bolt 122 to the left of the nut 128, a pair of washers 130 are received on the bolt 122 to the left of the loop 120 and a nut 132 firmly secures the loop between the washers 130 and the nut 128.

A microswitch 134, having a momentary toggle arm 136, is mounted above the cam 126. In the position shown in FIG. 20, the cam 126 will not have actuated the microswitch 134. However, if the cam 126 is turned in a counterclockwise direction by the pulling of the line 88, the cam 126 will move the arm 136 sufficiently to actuate the microswitch to initiate a timer or clock (not shown). After the line has been released from the wire 94, as described above, the lever 100 will move to the solid line position shown in FIG. 20 and the timer or clock will be running. The upper end 138 of the lever 100 will be connected to the upper end of the pipe 30 by means of a bungee cord 140, or other suitable elastic or resilient element, for the purpose of returning the lever 100 to the solid line position shown in FIG. 20.

As shown in FIGS. 19 and 20, the cam 126 is provided with a pair of arcuate slots 142 and 144. A bolt 146 is received in the arcuate slot 142 such that the shank 148 of the bolt extends forward of the pipe 30. A nut 150 is received on the bolt 146 to hold the same in the position shown in FIGS. 19 and 20. However, by loosening the nut 150, the bolt 146 can be positioned to any desired location in the slot 142. The purpose of the bolt 146 is to provide a stop for the rotation of the cam 126 so that the spring 94 will bend away from the arms 102 and 104 upon continued pulling of the line 88. The curvature of the outer surface of the cam 126 is such that the cam will have actuated the microswitch 134 by the time the shank 148 of the bolt 146 impinges against the forward edge of the pipe 30.

Figure 18:
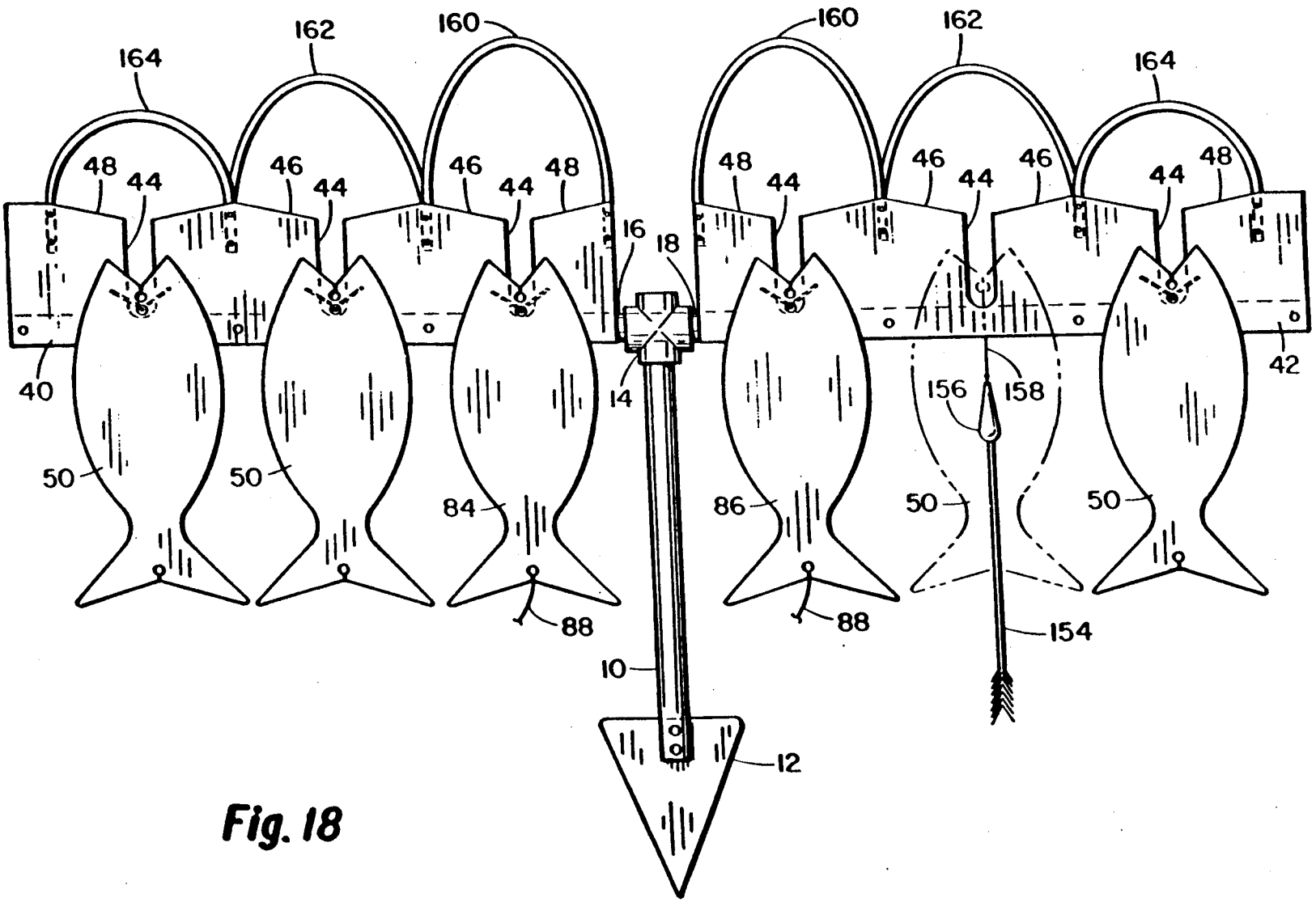
FIG. 18 is a front elevation, similar to FIG. 1, showing a fishing device for use in conjunction with a bow and arrow.

FIG. 18 shows a modification of the present invention for use with a bow and arrow. The bow (not shown) would be essentially conventional, but the arrow 154, as shown in FIG. 18, would be provided with a head 156 which is shaped like the plug 74 previously described. That is, the tip end of the head 156 would be provided with a taper portion 80 and a recess 82, although not specifically shown on the tip 156 of the arrow. A line 158 would be connected to the tip 156 of the arrowhead. A suitable reeling means (not shown) would be connected to the other end of the line 158 so as to reel in the arrow 154 after shooting the same. The device of FIG. 18 would include the same vertical pipe 10, spade 12, four-way connection 14, horizontal pipes 16 and 18 and plates 40 and 42 attached to the pipe 16 and 18, respectively, in the same manner described above in relation to FIG. 1. The plates 40 and 42 would be provided with notches 44 and members 46 and 48 as previously described. Although not shown on FIG. 18, it should be understood that a vertical pipe 20 would extend upwardly from the four-way coupling 14 and the elements shown attached to the pipe 20, as illustrated in FIGS. 1 and 19 through 21, would also be provided, except that the horizontal pipes 36 and 38 will be omitted. For the sake of simplicity, these feature are not shown in FIG. 18. However, wire loops are connected to the plates 40 and 42; that is, a large wire loop 160 connects from the inner edge of the member 48 to the center of the next adjacent member 46. A second smaller loop 162 connects from the center of the member 46, previously described, to the center of the next adjacent member 46. A still smaller loop 164 connects from the bottom of the loop 162 to the outer member 48. The lower ends of the loops 160, 162, 164 are conveniently bolted, or otherwise secured, to the plates 40 and 42.

When using the bow and arrow device shown in FIG. 18, the archer/fisherman will attempt to shoot the arrow 154 through either of the two loops 160 to catch the fish 84 or 86. When the line 158 is drawn into the opening 58 of the fish 84 or 86, pulling on the line 158 will cause the arrowhead 156 to be drawn into the opening 58 such that the head 156 is secured in the opening 58 in the same manner that the plug 74 was secured in the opening 58, as previously described. The continued pulling on the line 158 will initiate the timer (not shown) in the same manner as previously described while also permitting the withdrawal of the fish 84 or 86 from the plate 40 or 42, as the case may be. Because of the smaller size of the loop 162, the archer/fisherman will experience slightly more difficulty in getting the arrow through this loop. Also, even greater accuracy is required with respect to the smallest loop 164. Assuming that the archer/fisherman has first removed fish 84 to initiate the timer, he must then remove all the intermediate fish 50 so as to remove the fish 86 last. Removal of fish 86 will stop the timer and indicate the total transpired time for the removal of all of the fish.

Figure 6:
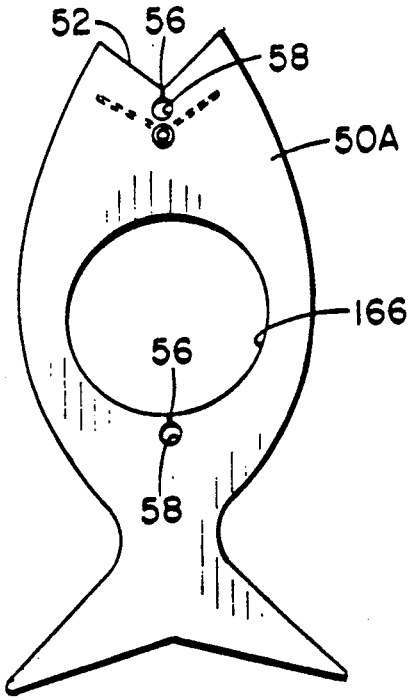
FIG. 6 is a front elevation, on a reduced scale, of a modified form of the fish shown in FIG. 2.

FIG. 6 shows a fish 50A which is similar to fish 50 previously described. The only difference between fish 50 and fish 50A is that the latter is provided with a large central opening 166 which can be used by an archer/-fisherman who must possess extreme accuracy to shoot an arrow through this opening. The lower end of the opening is provided with a slot 56 and an opening 58 which are the same as the slot 56 and opening 58, previously described. The fish 50A can be substituted for any or all of the fish 50 shown in FIGS. 1 or 18.

Figure 22:
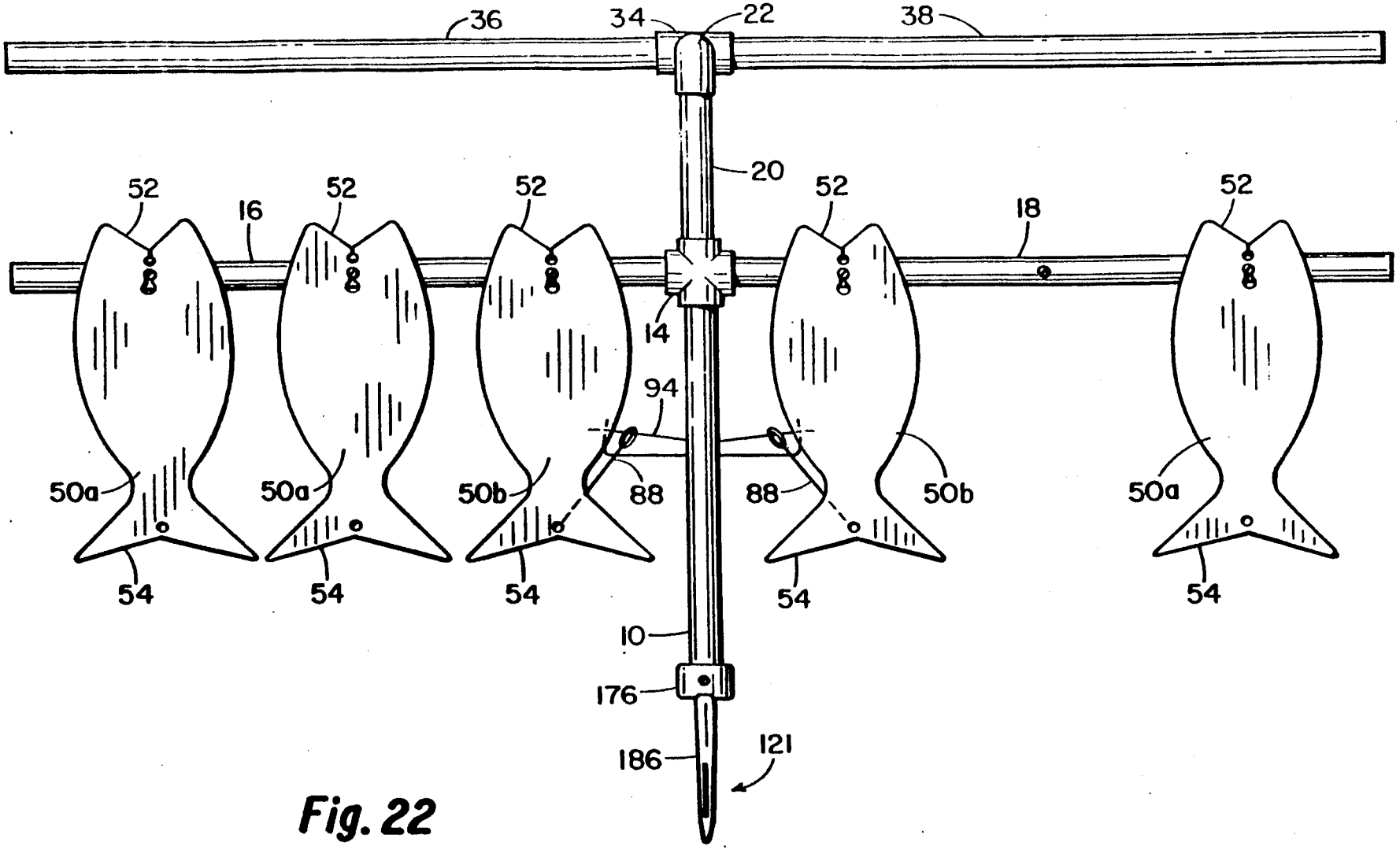
FIG. 22 is a front elevation similar to FIG. 1 showing a fishing device constructed in accordance with another embodiment of the present invention.

Referring now to FIG. 22, the structure illustrated therein is similar to that shown in FIGS. 1 through 4 and 19 through 21. That is, the device of FIG. 22 shows a vertical pipe 10 which can be impaled in the ground with a modified impaling device 12' (to be described later) The top of the pipe 10 connects with a four-way coupling 14 which in turn connects with a pair of horizontal pipes 16 and 18 and a vertical pipe 20. The top of the pipe 20 (see FIG. 19) connects with an elbow 22. The elbow 22 connects with a short horizontal piece of pipe 24 which connects with an inverted tee 26. The downward opening 28 of the tee 26 connects with a vertical piece of pipe 30 to the various elements shown in FIGS. 19 through 21, as previously described. The rear opening of the tee 26 connects with the nipple 32 which in turn connects with the tee 34. The sides of the tee 34 connect with the horizontal pipes 36 and 38, respectively, which, as previously indicated (in relation to the description of FIG. 1), are disposed parallel to, above and to the rear of, pipes 16 and 18 for the same reasons as previously described.

Figure 25:
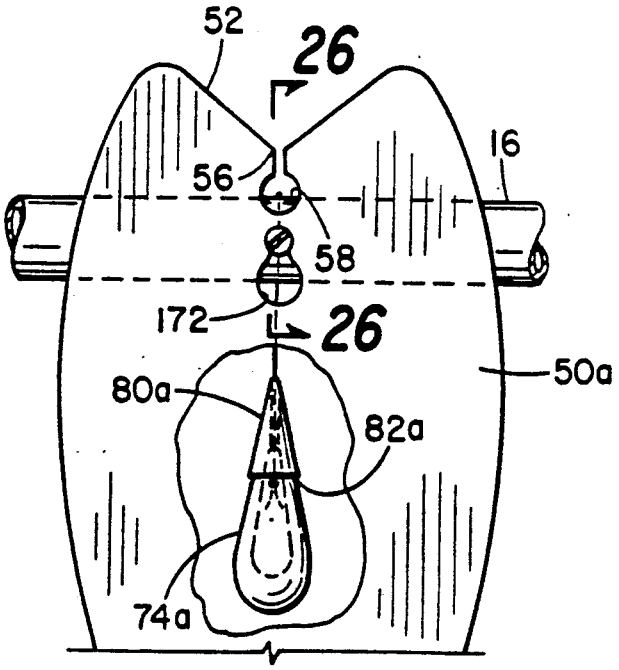
FIG. 25 is a partial front elevation, on an enlarged scale, of the upper portion of one of the fish shown in FIG. 22, together with a portion of the pipe on which the fish is mounted with a portion of the fish being broken away to show a modified form of plug.
Figure 26:
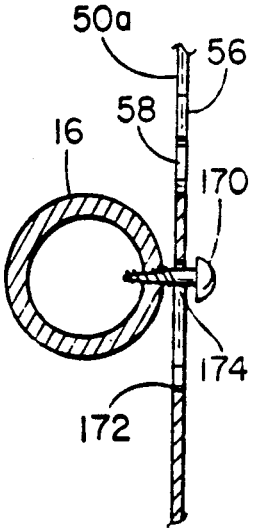
FIG. 26 is a sectional view taken along section line 26—26 of FIG. 25.

FIG. 22 shows a plurality of fish **50*a* which are supported on the pipes 16 and 18, in a manner later to be described, together with inner fish 50*b*, which are similar to the inside fish 84 and 86, previously described. Referring also to FIG. 25, each fish 50*a* (and 50*b*) is supported from the horizontal pipe 16 (or 18) by means of a screw 170 which is screwed horizontally into a suitable opening in the pipe 16. The upper end of the fish 50*a* is provided with an angled mouth portion 52 and a lower tail portion 54. The inner apex of the mouth 52 is provided with a narrow slot 56 which leads into a circular opening 58 in the same manner as described previously in connection with the fish 50 of FIG. 1. The fish 50*a*, however, is provided with an additional circular opening 172 disposed below the opening 58. The upper end of the opening 172 is provided with a vertical slot 174 which has a width approximately the same as the shank of the bolt 170, such that the fish 50*a* can be placed, or hung, on the horizontal pipe 16 by positioning the hole 172 of the head of the bolt 170 and then allowing the fish 50*a* to drop downwardly until the shank of the bolt 170 is received in the slot 174. The head of the bolt 170** which is spaced from the horizontal pipe will prevent the fish from falling off the horizontal pipe.

The inner fish **50*b* are provided with lines 88 which are received on the wire 94 in the same manner as described in relation to fish 84 and 86 and the description of FIGS. 19 to 21. The game of fishing, as it relates to FIG. 22, is similar to that shown in FIGS. 11 to 17. One of the differences between the method of fishing for FIG. 22 as compared to FIG. 1 is that FIG. 22 does not have slots 44 and, therefore, the fisherman must move the line 72 up so that it is positioned above the mouth 52 when pulling the "plug" over the upper pipe 36 as shown in FIGS. 13 and 14. If the line 72 falls in the mouth 52 of the fish 50***a* (or 50*b*) then it will pass into the slot 56 and into the circular opening 58.

As shown in FIG. 25, the lure 74*a* is slightly modified as compared to the lure 74 shown in FIG. 7. The lure 74*a* is provided with an upper portion 80*a* which tapers downwardly in the shape of a cone and which forms a recess 82*a* where the conical portion 84 connects with the bulbous portion 74*a*. The diameter of the recess 82*a* is slightly smaller than the opening 58 whereas the bottom of the tapered portion 80*a* is slightly larger than the opening 58.

When the line 72, immediately adjacent the plug 74*a*, is received in the slot 56 so it can pass into the opening 58, pulling on the line 72 will cause the tapered portion 80*a* to be received in the opening 58. Continued pulling (or jerking) on the line 72 will cause the entire tapered portion 80*a* to pass through the opening 58 until the sides of the opening are received in the recess 82*a*. Further tugging on the line 72 will cause the fish 50*a* to lift until the slot 174 passes upwardly above the shank of the screw 170 and the fish 50*a* will be released from the horizontal pipe 16. The same procedures will be involved in removing the fish 50*a* and 50*b* from the pipe 16 as previously described in FIGS. 1, 11 through 17, and 19 through 21; however, the starting fish will be one of the fish 50*b* and the stopping fish will be the other fish 50*b*.

Figure 23:
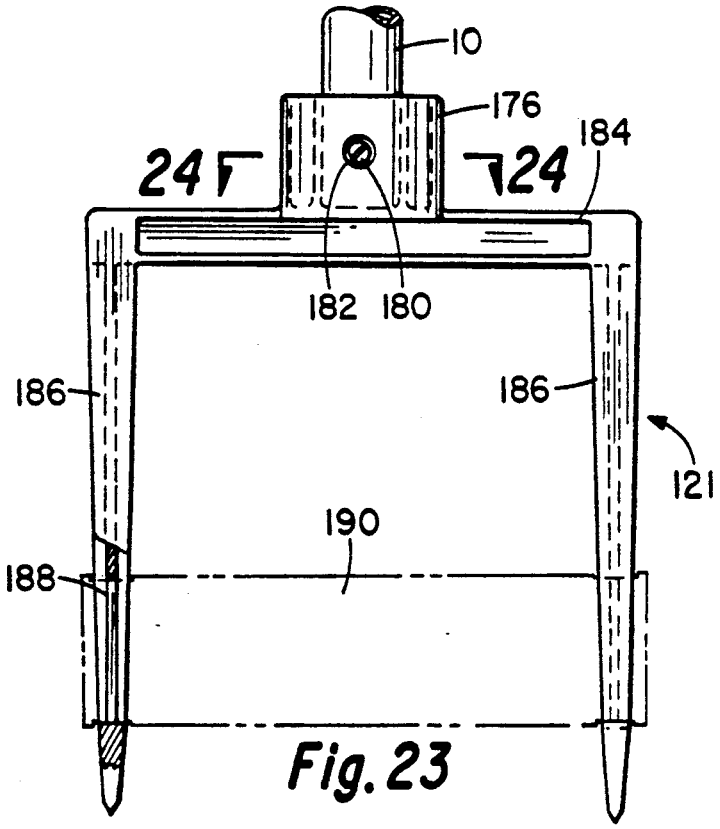
FIG. 23 is a side elevation, on an enlarged scale, of the bottom portion of the device shown in FIG. 22 and, also, the device shown in FIG. 27 as it would appear viewed along line 2313 23 of FIG. 27.
Figure 24:
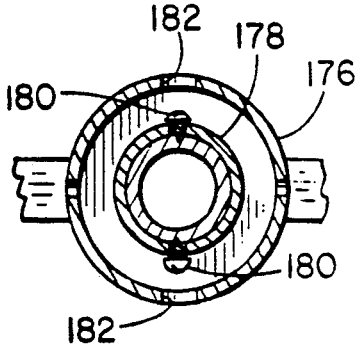
FIG. 24 is a sectional view taken along section line 24—24 of FIG. 23.

Turning now to FIGS. 23 and 24, the impaling means 12' includes a cup 176 having a central annular collar 178 whose inner diameter is substantially equal to the outer diameter of the vertical pipe 10. A pair of set screws 180 are received in suitable holes in the collar 178. Access openings 182 are provided at opposite sides of the cup 176 so the screws 180 can be tightened by means of a screwdriver (not shown) which can be inserted in the openings 182 so as to secure the cup 176 to the lower end of the pipe 10. The cup 176 is mounted on a horizontal bar 184 which connects, at its ends, to a pair of vertical spikes 186 which are spaced apart as shown. By placing one's foot on the horizontal bar 184, the spikes 186 can be driven into the ground so as to support the pipe 10 in a vertical position. If desired, the spikes 186 can be provided with vertical slots 188 adjacent the lower ends thereon such that a thin vertical membrane, or plate, 190 can be positioned in the slots 188. If the spikes 186 are driven into the ground with the vertical membrane 190 positioned in the slots 188, the vertical membrane can provide additional vertical stability to the ground connection.

It should be understood that all of the elements shown in FIGS. 19 to 21 are mounted on the structure shown in FIG. 22.

Figure 27:
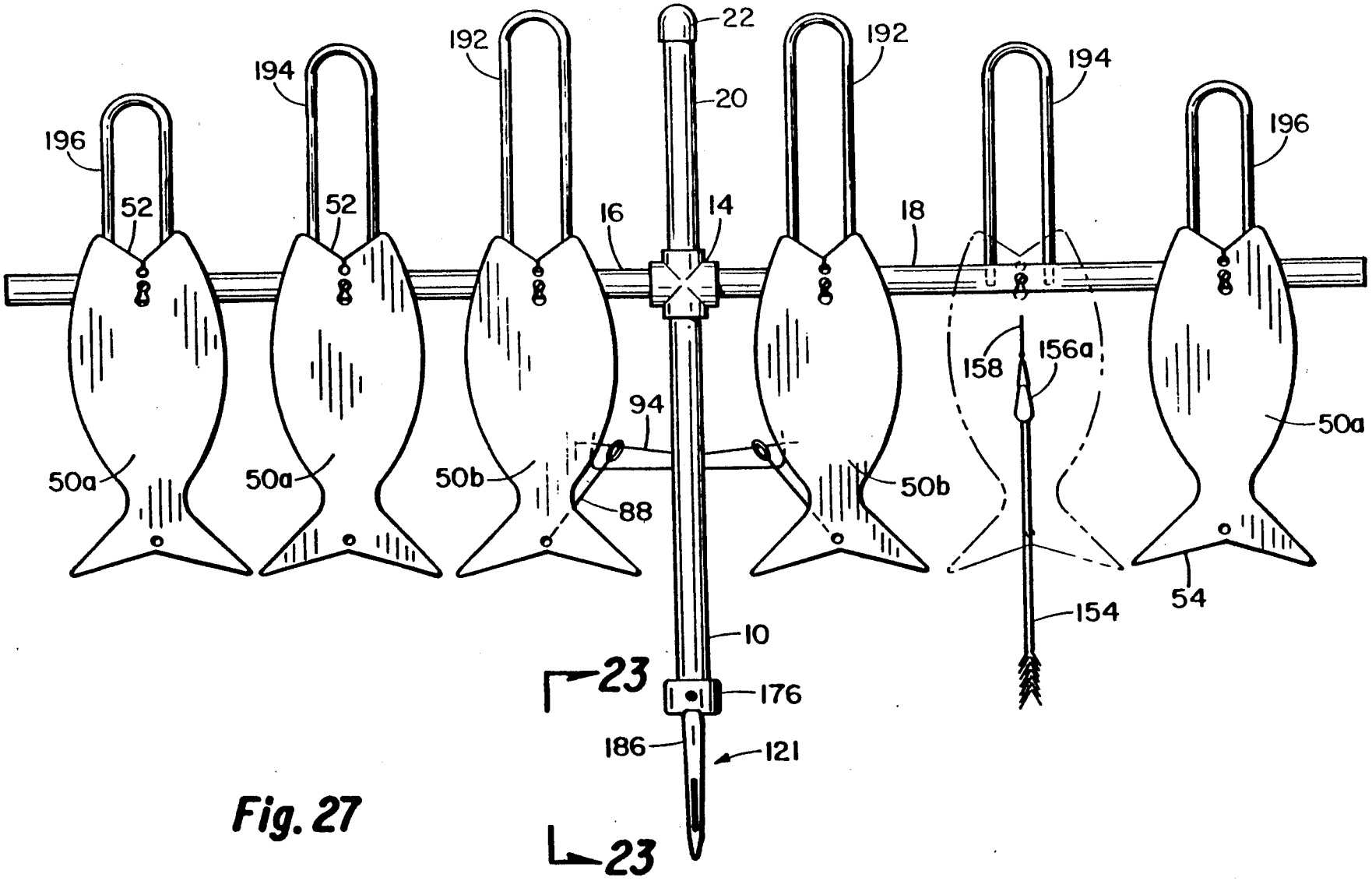
FIG. 27 is a front elevation similar to FIG. 22 showing a still further embodiment of the present invention.

Turning now to FIG. 27, this represents an embodiment for use in connection with the fisherman who likes to fish with a bow and arrow. The same structure will be utilized in FIG. 27 as is shown in FIGS. 19 through 22, except the tee 34 and the upper horizontal pipes 36 and 38 will be eliminated. Instead, a plurality of inverted "U" shaped members 192, 194 and 196 are secured to the horizontal pipes 16 and 18 in alignment with the mouth portions 52 of the fish 50*a* and 50*b*. It will be noted that the "U" shaped members 192 are higher (or longer) than the "U" shaped members 194 and the "U" shaped members 194 are similarly higher than the "U" shaped members 196. This difference represents the degree of difficulty in shooting an arrow through the opening provided by the "U" shaped member. Thus, 192 would be the easiest, and 196 would be the hardest. The arrow 154 would be essentially the same as the arrow 154 as described in relation to FIG. 18, except that the tip 156*a* would be in the shape of the plug 74*a* shown in FIG. 25 and the head 156 would be connected to the line 158 in the same manner as previously described.

Whereas the present invention has been disclosed in terms of the specific structure described above, it should be understood that other and further modifications, apart from those shown or suggested herein, may be made within the spirit and scope of this invention.

What is claimed is:

1. A fishing apparatus comprising a horizontal support, a plurality of flat, relatively thin, fish shaped members each having the outline of a fish and each having an upper end forming an angled mouth and a lower end resembling the tail of a fish, each fish shaped member having a circular opening therein mounted directly below the mouth of the said fish shaped member and a slot leading from the mouth of the fish shaped member to the circular opening, the fish shaped members being mounted along the horizontal support in a substantially vertical disposition and in a spaced horizontal arrangement, each fish shaped member being connected to the horizontal support by a releasable holding means, a plug adapted to be connected to the end of a casting line so that the plug and line can be cast over the angled mouths of the fish shaped members, each plug being made of resilient material and being provided with a nose piece adjacent to the connection of the line to the plug, the nose piece tapering outwardly from a diameter of smaller size than the circular opening in the fish shaped member where the plug connects to the line to a diameter slightly larger than the diameter of the opening in the fish shaped member, the plug being provided with a recess beyond the larger diameter of the nose piece so that, when the plug is pulled into a circular opening in a fish shaped member, the nose piece will squeeze through the opening until the sides of the opening are received in the recess of the plug, so that pulling on the line after the plug has been received in the circular opening will cause the fish shaped member to pull against the releasable holding means to release the fish shaped member from the horizontal support.

2. A fishing apparatus according to claim 1 wherein a horizontal bar is mounted above and behind the horizontal support whereby the plug and line can be cast over the horizontal bar to assist in locating the plug and line with respect to an angled mouth of a fish shaped member.

3. A fishing apparatus according to claim 1 wherein a timing mechanism is associated with the apparatus, wherein the removal of a first preselected fish shaped member will initiate the actuation of the timing mechanism and, wherein the removal of a second preselected fish shaped member will terminate the operation of the timing mechanism.

4. A fishing apparatus according to claim 3 wherein the timing mechanism consists of a cam support, a cam shaft rotatably mounted in said cam support, an arcuate cam mounted on said cam shaft for rotation therein, a lever having an upper end and a lower end and being connected intermediate its ends to said cam shaft for rotating said cam, a microswitch mounted on said cam support for actuation thereof in response to a first predetermined rotation of said cam to actuate a timer, a resilient means connected between the upper end of said lever and said cam support for maintaining said lever in a substantially vertical position, a stop mounted on said cam for preventing rotation of said cam beyond a second predetermined rotation thereof, a first cable means having one end thereof releasably attached to the lower end of said lever and having another end thereof connected to the first preselected fish shaped member, a second cable having one end thereof releasably secured to the lower end of said lever and having another end connected to another preselected fish shaped member whereby removal of the first preselected fish shaped member will cause rotation of said cam to actuate said microswitch to initiate the operation of said timer and whereby removal of said second preselected fish shaped member will again rotate said lever to actuate the microswitch to stop the timer.

5. A fishing apparatus according to claim 1 wherein the horizontal support is provided with a plurality of vertically projecting loops disposed over the angled mouths of the fish shaped members and wherein the plug constitutes the head of an arrow.

6. A fishing apparatus according to claim 1 wherein at least one of said fish shaped members is provided with a second circular opening of larger diameter than the first mentioned circular opening and being disposed below the first mentioned circular opening, a third circular opening disposed below said second circular opening and being of substantially the same size as the first mentioned circular opening and a second slot leading from the second circular opening to the third circular opening.

7. A fishing apparatus according to claim 1 wherein the horizontal support is provided with a relatively thin vertical member extending horizontally along the horizontal support having a relatively horizontal thickness and having a plurality of spaced vertical notches therein, each fish shaped member being provided with a wire latch shaped in the form of a "V" and disposed away from said fish shaped member at a distance slightly greater than the thickness of said vertical member whereby a fish shaped member can be retained in each vertical notch and held therein by the wire latch, whereby the plug and line can be cast over the notches, the wire latch on each fish shaped member being sufficiently resilient that pulling on the line after the plug has been received in the circular opening will cause the wire latch to bend sufficiently to permit removal of the fish shaped member from the notch.

8. A fishing apparatus according to claim 7 wherein the vertical member is provided with tapered portions between the notches, the tapered portions having tapered edges which permit a fishing line to be received thereon to slide down into the notches on opposite sides of each tapered portion.

9. A fishing apparatus according to claim 1 wherein each releasable holding means is formed by a second circular opening in each fish shaped member below the first mentioned circular opening and wherein each second circular opening has a vertical slot extending upwardly therefrom, a plurality of horizontal screws attached to the horizontal support in spaced horizontal arrangement, one horizontal screw being provided for each fish shaped member, each horizontal screw having a head spaced from the horizontal support and having a shank between the head and the horizontal support whose diameter is substantially equal to the width of the vertical slot which projects upwardly from each second circular opening, whereby each fish shaped member is supported on the horizontal support by having the shank of the bolt received in the vertical slot.

* * * * *